US005106069A

United States Patent [19]

Wolf et al.

[11] Patent Number: 5,106,069

[45] Date of Patent: Apr. 21, 1992

[54] APPARATUS FOR POSITIONING COVERS ON STACKS OF SUPERIMPOSED SHEETS

[75] Inventors: Wolfram Wolf, Bilsen; Jürgen Peter, Hamburg, both of Fed. Rep. of Germany

[73] Assignee: E.C.H. Will GmbH, Hamburg, Fed. Rep. of Germany

[21] Appl. No.: 606,442

[22] Filed: Oct. 31, 1990

[30] Foreign Application Priority Data

Nov. 7, 1989 [DE] Fed. Rep. of Germany ..... 3937044

[51] Int. Cl.[5] ..... B65H 39/02

[52] U.S. Cl. ..... 270/54; 198/418.3; 270/58; 414/789

[58] Field of Search ..... 414/788, 788.1, 788.9, 414/789, 789.1, 789.5, 789.6, 790.3, 793.4; 198/418.3; 271/223, 224; 270/54, 58

[56] References Cited

U.S. PATENT DOCUMENTS

| | | | |
|---|---|---|---|
| 1,717,430 | 6/1929 | Young et al. | 198/418.3 |
| 2,872,020 | 2/1959 | Hansel et al. | 198/418.3 |
| 3,414,257 | 12/1968 | Muller | 270/54 X |
| 3,978,571 | 9/1976 | Orlando et al. | 414/789.6 X |
| 4,387,890 | 6/1983 | Lampe . | |
| 4,502,592 | 3/1985 | Ramcke . | |
| 4,508,210 | 4/1985 | Ramcke . | |
| 4,541,764 | 9/1985 | Govan et al. | 414/790.3 X |
| 4,710,256 | 12/1987 | Ladewig . | |
| 4,801,036 | 1/1989 | Rathert | 198/418.3 X |

*Primary Examiner*—Robert J. Spar
*Assistant Examiner*—Craig Slavin
*Attorney, Agent, or Firm*—Peter K. Kontler

[57] ABSTRACT

Apparatus for positioning covers on top of stacks of paper sheets has a transporting unit which advances a series of successive stacks along a first horizontal path and discrete covers along a second horizontal path above and adjacent the first path. The covers are accelerated by advancing along a downwardly sloping portion of the second path immediately ahead of two vertical rotary members which temporarily intercept an oncoming cover until the corresponding stack catches up with the intercepted cover. The lower portion of the stack then moves the rotary members apart to enable the stack and the cover thereon to advance along the first path beyond the rotary members. Each rotary member is mounted on a spring-biased or otherwise biased lever which is pivotable about a vertical axis.

10 Claims, 3 Drawing Sheets

Fig.5
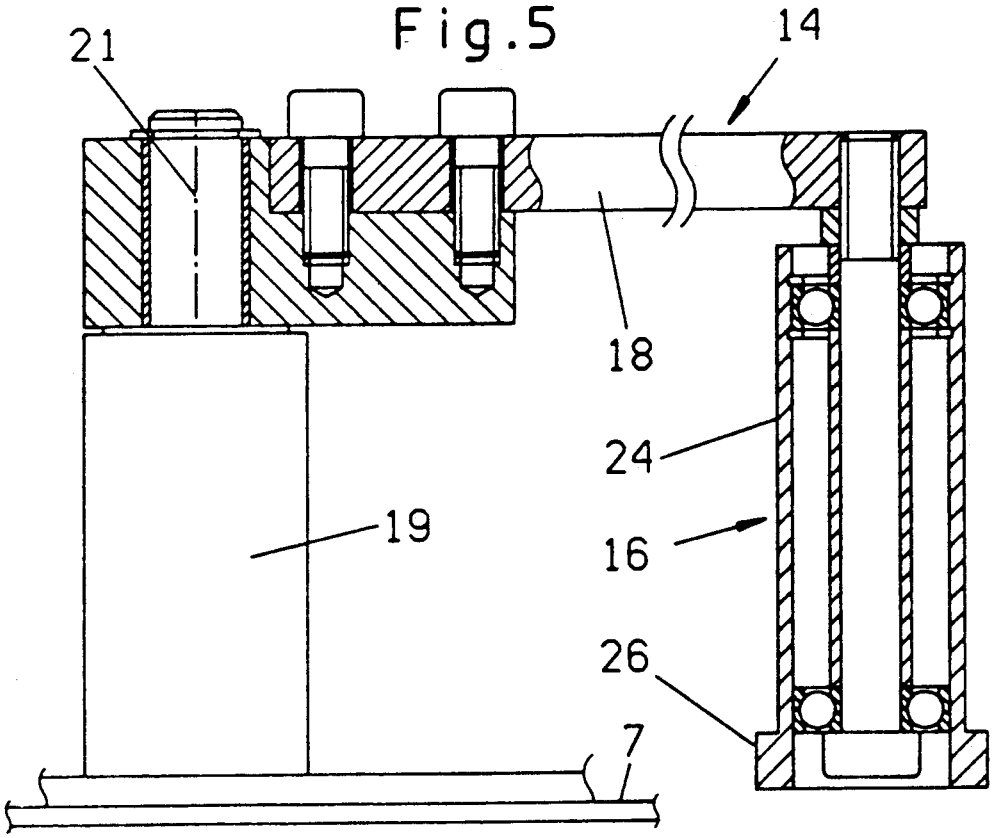
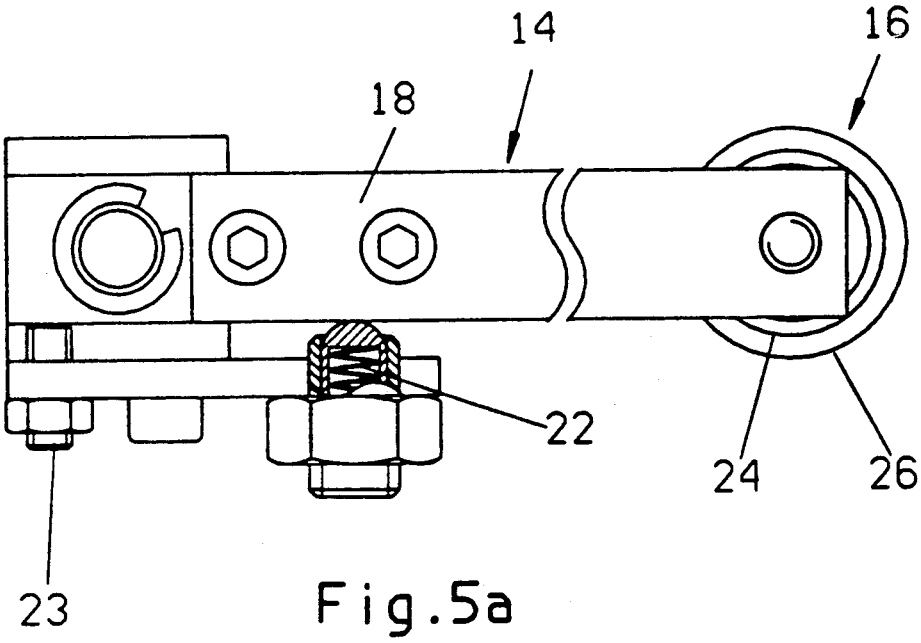
Fig.5a

APPARATUS FOR POSITIONING COVERS ON STACKS OF SUPERIMPOSED SHEETS

BACKGROUND OF THE INVENTION

The invention relates the processing of sheets in general, and more particularly to improvements in apparatus for positioning sheet-like covers on top of stacks of paper sheets or the like. Still more particularly, the invention relates to improvements in apparatus wherein covers (e.g., covers made of cardboard or plastic material) are placed on top of successive stacks of a series of moving stacks or superimposed paper sheets or the like.

It is often necessary to place a relatively stiff cover on top of a stack of superimposed paper sheets or other sheets. For example, a cover will be placed on top of a stack which consists of pressure-sensitive sheet-like forms or blanks before the stack is draped into a web of paper or the like.

Certain stationery products (such as pads) also require covers which are placed on top of and are secured (e.g., stapled or bonded) to stacks of aligned paper sheets. It is also known to assemble covers of blotting paper with stacked sheets of writing paper.

Presently known apparatus for positioning covers on top of stacks of papers sheets or the like employ conveyors which transport the stacks and the covers in the same direction, and complex aligning devices which are designed to ensure that each cover is properly aligned with the corresponding stack prior to attachment of the cover to the stack and/or prior to draping of the cover and the stack into a blank of paper, plastic foil or the like. The aligning operation must be carried out with utmost care because the appearance of the ultimate product (such as a writing pad) is greatly affected by the lack of proper alignment of the cover with the sheets of the stack. Moreover, it is difficult to properly pile stacks on top of each other or to properly wrap the stacks if their sheets are not accurately aligned with the respective cover or covers.

OBJECTS OF THE INVENTION

An object of the invention is to provide a novel and improved apparatus which can position successive covers on top of successive stacks of superimposed paper sheets or the like with a high degree of accuracy and irrespective of the speed at which the stacks are transported during assembly with the covers.

Another object of the invention is to provide the apparatus with novel and improved means for accurately positioning successive covers on top of discrete stacks while the stacks are in continuous motion.

A further object of the invention is to provide the apparatus with novel and improved means for temporarily intercepting the covers while the stacks are in continuous motion.

An additional object of the invention is to provide an apparatus which can be rapidly converted for the positioning of larger or smaller covers relative to larger or smaller stacks.

Still another object of the invention is to provide a simple and inexpensive but reliable apparatus which can be installed in existing production lines for stationery products and the like.

A further object of the invention is to provide a novel and improved method of assembling discrete covers with stacks of superimposed paper sheets or the like.

SUMMARY OF THE INVENTION

The invention is embodied in an apparatus for positioning and aligning sheet-like covers on top of stacks of superimposed sheets. The improved apparatus comprises means for transporting a series of successive stacks and discrete covers for successive stacks of the series in a predetermined direction along separate first and second paths so that the path for the covers is located above the path for the stacks and the leading edges of covers are located ahead of the corresponding stacks when the covers reach a predetermined portion of their path, and means for temporarily intercepting successive covers in the predetermined portion of their path until the corresponding stacks catch u with the intercepted covers.

The intercepting means preferably comprises two rotary members which are disposed at opposite sides of the two paths, and means for yieldably maintaining the rotary members in predetermined positions at a distance from each other which is slightly less than the width of a cover so that the leading edges of successive incoming covers impinge upon and are temporarily intercepted by the rotary members. The rotary members are preferably rotatable about axes which are substantially normal to the predetermined direction and are vertical if the paths for the stacks and for the covers are substantially horizontal.

The maintaining means preferably includes means for confining the rotary members to movements along predetermined paths away from each other in response to impingement of leading edges of oncoming covers against the rotary members. The maintaining means can comprise a lever for each rotary member and means for biasing the levers in directions to yieldably maintain the rotary members in the predetermined positions. The levers are preferably pivotable about axes which are at least substantially parallel to the axes of rotation of the respective rotary members.

Each rotary member preferably includes a smaller-diameter portion which is contacted by the leading edge of an oncoming cover, and a larger-diameter portion which is engaged by an oncoming stack so that the oncoming stack moves the rotary members away from each other to thus enable the stack and the cover thereon to proceed in the predetermined direction. The transporting means can include a support (e.g., a table) which defines the path for successive stacks of the series of stacks, and the larger-diameter portions of the rotary members are preferably adjacent the support to be engaged by the bottom part of an oncoming stack, i.e., by that part which is least likely to be deformed as a result of impingement upon the larger-diameter portions of the rotary members.

The transporting means can include a ramp which defines a portion of the path for successive covers and slopes downwardly in the predetermined direction toward the path for the stacks to preferably effect acceleration of successive covers, most preferably during the last stage of transport of covers toward engagement with the smaller-diameter portions of the rotary members. The transporting means can further comprise at least one endless conveyor (e.g., a chain) having a plurality of entraining elements in the form of pushers each of which serves to simultaneously advance a stack and a cover along the respective paths toward the intercepting means. The ramp ensures acceleration of successive covers slightly ahead of the intercepting means so that the leading edges of the covers reach the smaller-diameter portions of the rotary members before the respective stacks reach the larger-diameter portions of the rotary members.

The apparatus preferably further comprises lateral guide means for successive stacks in the respective path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 5 is an enlarged partly side elevational and partly vertical sectional view of one-half of the intercepting means; and FIG. 5*a* is a plan view of the structure which is shown in FIG. 5.

DESCRIPTION OF PREFERRED EMBODIMENTS

Figure 1:
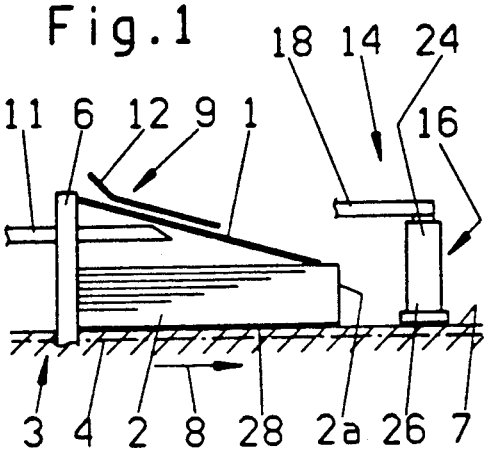
FIG. 1 is a fragmentary partly side elevational and partly longitudinal vertical sectional view of an apparatus which embodies the invention, a cover and a stack being shown in the process of advancing toward the intercepting means.

The apparatus which is shown in FIGS. 1 to 4*a* comprises a transporting unit 3 which serves to advance a series of successive stacks 2 of superimposed paper sheets along a first horizontal path, namely along the upper side of a table 7 or an analogous support, and to simultaneously advance a series of discrete covers 1 along a second horizontal path at a level above the first path. The direction of joint advancement of stacks 2 and covers 1 is indicated by the arrow 8. The path for the covers 1 is defined in part by a longitudinally slotted horizontal plate 11 which is spaced apart from the topmost sheets of stacks 2 in the lower path.

In addition to the table 7 and plate 11, the transporting unit 3 comprises an endless conveyor 4 (e.g., a chain conveyor having a horizontal upper reach adjacent the upper side of the table 7) which is provided with outwardly extending entraining elements in the form of pushers 6. These pushers extend upwardly through a longitudinally extending slot of the table 7 as well as through a longitudinally extending slot of the plate 11 so that each pusher can advance a stack 2 as well as a discrete cover 1 above and spaced apart from the topmost sheet of the respective stack. Successive pushers 6 descend at the discharge end of the endless conveyor 4 to thereupon advance with the lower reach of the conveyor toward a location where they engage freshly supplied stacks 2 and covers 1. Commonly owned U.S. Pat. No. 4,710,256 to Ladewig et al. shows an endless stack transporting conveyor with pushers which can advance covers or cover sheets jointly with stacks of superimposed paper sheets or the like. Similar conveyors with pushers for stacks of paper sheets or the like are shown in commonly owned U.S. Pat. No. 4,387,890 to Lampe, in commonly owned U.S. Pat No. 4,502,592 to Ramcke, and in commonly owned U.S. Pat. No. 4,508,210 to Ramcke et al. The disclosures of these patents are incorporated herein by reference.

The longitudinally slotted plate 11 and a downwardly and forwardly sloping ramp 12 constitute that section (9) of the transporting unit 3 which directs successive foremost covers 1 on the plate 11 downwardly toward and forwardly beyond the front side 2*a* of the corresponding stack 2. This can be seen in FIG. 2.

The path for the stacks 2 on the table 7 is flanked by lateral guide members 13.

The improved apparatus further comprises a device 14 which serves to intercept successive foremost covers 1 at an aligning station which is located downstream of the ramp 12 and at which an oncoming cover 1 is temporarily intercepted so that the corresponding stack 2 can catch up with the intercepted cover. The intercepting device 14 comprises two spaced apart vertical rotary members 16 and 17 which are rotatable about vertical axes, i.e., about axes which are normal to the direction (arrow 8) of advancement of stacks 2 toward the intercepting device. The means for maintaining the rotary members 16, 17 in predetermined positions (such positions are shown in FIG. la and the distance d between the members 16, 17 is then less than the width w of a cover 1) includes two elongated levers 18 (see particularly FIGS. 5 and 5*a*) which are biased by springs 22 or by other suitable yieldable biasing means so that the rotary members 16, 17 can be pushed away by an oncoming stack 2. Each lever 18 has a front end which carries the respective rotary member and a rear end adapted to turn about a vertical axis which is parallel to the axis of rotation of the respective rotary member. To this end, the rear ends of the levers 18 are turnable about vertical shafts 21 which are mounted on or form part stationary upright columns 19. The extent of pivotability of levers 18 about the axes of the respective shafts 21 can be rather limited, as long as it suffices to permit the corresponding rotary members 16, 17 to leave the path for the stacks 2 against the opposition of the respective springs 22. Screws 23 or other suitable adjustable stops are provided to select the extent of pivotability of the levers 18 under the action of stacks 2.

Each rotary member comprises a relatively long smaller-diameter upper portion 24 which can be engaged by the leading edge la of an oncoming cover 1, and a relative short larger-diameter lower portion 26 which is disposed directly above or close to the level of the upper side of the table 7 so that it can be engaged by the front side of the lowermost portion of an oncoming stack 2. Such lowermost portion is least likely to change its orientation or to permit a shifting of its sheets in response to impingement upon the peripheral surfaces of the lower portions 26.

Figure 2:
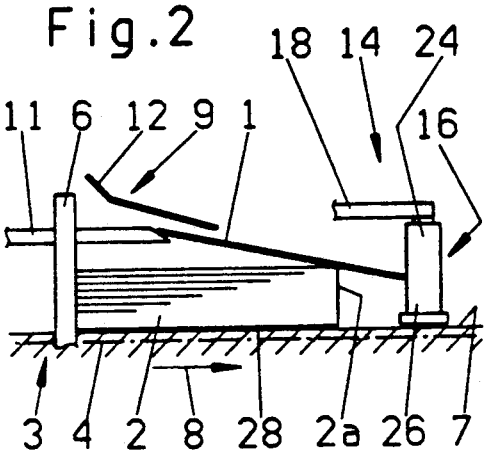
FIG. 2 is a view similar to that of FIG. 1 but showing the leading edge of the cover in engagement with the rotary members of the intercepting means.
Figure 3:
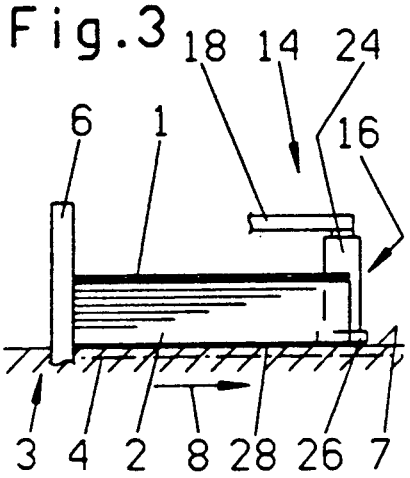
FIG. 3 is a view similar to that of FIG. 1 or 2 but showing the stack and the cover in the process of jointly advancing between the laterally displaced rotary members of the intercepting means.
Figure 4:
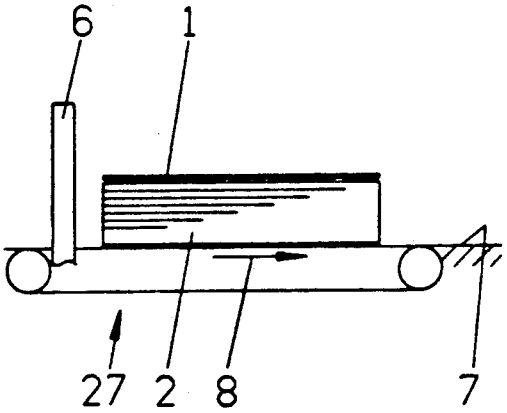
FIG. 4 is a fragmentary side elevational view showing that portion of the apparatus which receives and advances stacks and aligned covers downstream of the intercepting means.

FIGS. 1, 2 and 3 show that the stacks 2 need not rest on or slide directly along the upper side of the table 7. Thus, each such stack 1 can advance on top of and with a second or bottom cover 28.

The operation of the improved apparatus is as follows:

The conveyor 4 of the transporting unit 3 continuously advances a series of successive suitably spaced apart stacks 2 along the respective path above the table 7, and each such stack includes a bottom cover 28 which has or can have the same size as the sheets of the respective stack. At the same time, each pusher 6 of the conveyor 4 advances a cover 1 which slides along the plate 11 of the transporting unit section 9 toward the ramp 12. In order to facilitate the advancement of stacks 2 and of the corresponding bottom covers 28 beneath the plate 11, the apparatus can comprise one or more endless belt or band conveyors (three shown at 27 in FIGS. 4 and 4*a*) having upper reaches at or even slightly above the upper side of the table 7 and advancing at the speed of the upper reach of the conveyor 4, i.e., at the speed of the pushers 6. The bottom covers 28 can be bonded or stapled to the adjacent sheet or sheets of the respective stacks 2 before the stacks 2 are fed onto the conveyor 4 upstream of the ramp 12.

The means for feeding successive discrete covers 1 onto the plate 11 is not shown in the drawing. Such feeding means preferably comprises a conveyor which delivers successive discrete covers 1 onto the plate 11 at right angles to the direction which is indicated by the arrow 8 and in front of the oncoming pushers 6 on the conveyor 4. A pusher 6 which approaches the ramp 12 engages the rear side of a stack 2 on the table 7 (or on the conveyors 27) and the rear or trailing edge 1*b* of a cover 1. The underside of the ramp 12 deflects the leading edge 1*a* of the cover 1 downwardly so that the area of contact between the underside of the cover 1 beneath the ramp 12 and the upper side of the plate 11 is greatly reduced (e.g., to zero) so that the cover 1 is accelerated in the direction of arrow 8 and its front end face or leading edge la reaches the peripheral surfaces of the relatively long upper portions 24 of the rotary members 16, 17 before the lower portions 26 of such rotary members are engaged and moved apart by the front side 2*a* of the oncoming stack 2. Acceleration of a cover 1 which approaches the rotary members 16, 17 of the intercepting device 14 is assisted by the cushion of air between the underside of such cover and the upper side of the respective stack 2.

Figure 1A:
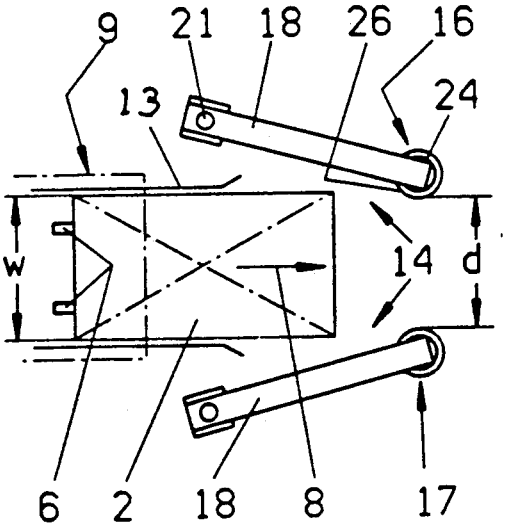
FIG. 1*a* is a plan view of the structure which is shown in FIG. 1.
Figure 2A:
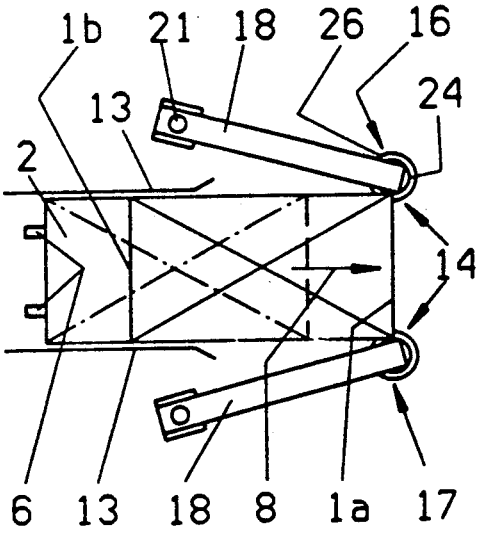
FIG. 2*a* is a plan view of the structure which is shown in FIG. 2.
Figure 3A:
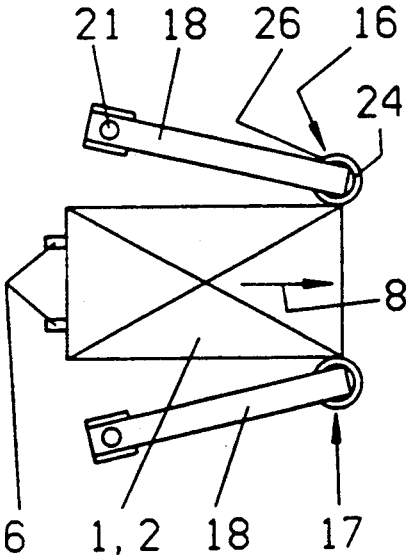
FIG. 3*a* is a plan view of the structure which is shown in FIG. 3.
Figure 4A:
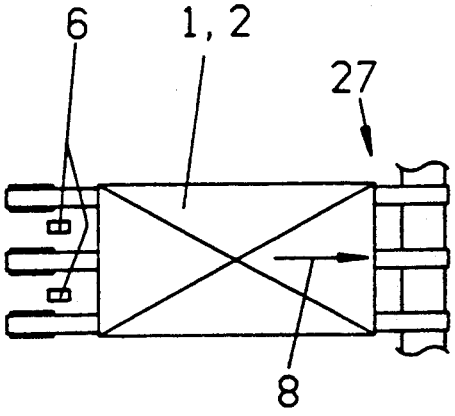
FIG. 4*a* is a plan view of the structure which is shown in FIG. 4.

The rotary members 16, 17 can be said to constitute upright idler rollers, and the minimum distance d between the upper portions 24 in the predetermined positions (FIG. 1*a*) of the rotary members 16, 17 is slightly less than the width w of a cover 1. The peripheral surfaces of the upper portions 24 not only intercept and temporarily arrest but also center the oncoming cover 1 so that the cover accurately overlaps the topmost sheet of the stack 2 below it (FIGS. 3 and 3*a*) when the lower portion of the oncoming stack reaches the lower portions 26. The bias of the springs 22 is selected in such a way that the rotary members 16, 17 can yield and cause the respective levers 18 to move them along predetermined arcuate paths away from the predetermined positions of FIG. 1*a*. This enables the stack 2 and the cover 1 thereon to advance between and beyond the rotary members 16, 17 on its way toward the next processing station, e.g., to a station where the stacks 2 and the respective covers 1, 28 are draped into blanks of paper or the like.

An important advantage of the improved apparatus is its simplicity. Thus, it is not necessary to employ complex electronic or other sensors or detectors to track the positions of the stacks 2 and/or covers 1. The upper portions 24 of the rotary members 16, 17 automatically intercept and temporarily hold as well as center successive covers 1 until the respective stacks 2 catch up, and the stacks then automatically increase the distance between the rotary members 16, 17 to permit the stacks and the covers to advance beyond the intercepting station.

An advantage of rotary members with larger-diameter lower portions 26 is that the lower portion of an oncoming stack 2 can move the relatively long upper portions 24 away from the adjacent cover 1 and from the sheets which are adjacent the cover. The lower portion of a stack is more solid (i.e., less likely to undergo deformation) than the upper portion. In addition, and if the stacks 2 rest on bottom covers 28, the lower portions 26 of the rotary members 16, 17 can be engaged by the bottom covers 28 so that the sheets of a stack 2 are even less likely to undergo deformation during advancement past the intercepting device 14. The difference between the diameters of the upper and lower portions 24, 26 of the rotary member 16 or 17 can be small or extremely small.

The ramp 12 constitutes a desirable and advantageous element of the transporting unit 3, and more particularly of the upper section 9 of the transporting unit. This ramp promotes the advancement of successive covers 1 toward the intercepting device 14 in such a way that the leading edge la of a cover 1 can reach the upper portions 24 of the rotary members 16, 17 before the corresponding stack 2 reaches the lower portions 26.

An additional important advantage of the improved apparatus is that the intercepting device 14 need not include and need not be combined with one or more prime movers and hence does not consume any energy. The movements of its parts (namely pivotal movements of the levers 18 and angular movements of the rotary members 16, 17) are induced by the oncoming covers 1 and stacks 2. The apparatus can be installed in existing production lines for stationery products including writing pads, wrapped reams of paper sheets and/or other products wherein covers must be moved to positions of accurate overlap with stacked sheets of paper or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for positioning sheet-like covers having a predetermined width on top of stacks of superimposed sheets, comprising means for transporting a series of stacks and discrete covers for successive stacks of the series in a predetermined direction along separate paths, the path for the covers being located above the path for the stacks and the covers having leading edges which are located ahead of the corresponding stacks when the covers reach a predetermined portion of their path; and means for temporarily intercepting successive covers in said predetermined portion until the corresponding stacks catch up with the intercepted covers, said intercepting means comprising two rotary members disposed at opposite sides of said paths and means for yieldably maintaining said rotary members in predetermined positions at a distance from each other which is slightly less than said predetermined width so that the lading edges of successive oncoming covers impinge upon and are temporarily intercepted by said rotary members.

2. The apparatus of claim 1, wherein said members are rotatable about axes which are substantially normal to said predetermined direction.

3. The apparatus of claim 2, wherein said maintaining means includes means for confining said rotary members to movements along predetermined paths away from each other upon impingement of leading edges of oncoming covers against said rotary members.

4. The apparatus of claim 2, wherein said maintaining means comprises a lever for each of said rotary members and means for biasing said levers to yieldably maintain said rotary members in said predetermined positions.

5. The apparatus of claim 4, wherein said levers are pivotable about axes which are at least substantially parallel to the axes of said rotary members.

6. The apparatus of claim 1, wherein each of said rotary members includes a smaller-diameter portion which is contacted by the leading edge of an oncoming cover and a larger-diameter portion which is engaged by an oncoming stack whereby the oncoming stack moves said rotary members away from each other so that the stack and the cover thereon can proceed in said predetermined direction.

7. The apparatus of claim 6, wherein said transporting means includes a support which defines the path for successive stacks of said series and said larger-diameter portions of said rotary members are adjacent said support.

8. The apparatus of claim 1, wherein said transporting means includes a ramp which defines a portion of the path for successive covers and slopes downwardly in said predetermined direction toward the path for stacks.

9. The apparatus of claim 1, wherein said transporting means comprises at least one endless conveyor having a plurality of pushers each arranged to simultaneously advance a stack and a cover along the respective paths toward said intercepting means.

10. The apparatus of claim 1, further comprising lateral guide means for stacks in the respective path.

* * * * *